US007699678B2

(12) United States Patent
Cannon

(10) Patent No.: US 7,699,678 B2
(45) Date of Patent: Apr. 20, 2010

(54) BINDING FOR WATER SPORTS BOARDS

(75) Inventor: Douglas A. Cannon, Arlington, WA (US)

(73) Assignee: Connelly Skis, Inc., Lynnwood, WA (US)

( * ) Notice: Subject to any disclaimer, the term of this patent is extended or adjusted under 35 U.S.C. 154(b) by 86 days.

(21) Appl. No.: 11/817,402

(22) PCT Filed: Aug. 15, 2006

(86) PCT No.: PCT/US2006/032075

§ 371 (c)(1),
(2), (4) Date: Aug. 29, 2007

(87) PCT Pub. No.: WO2007/022328

PCT Pub. Date: Feb. 22, 2007

(65) Prior Publication Data

US 2008/0254692 A1 Oct. 16, 2008

Related U.S. Application Data

(63) Continuation of application No. 11/206,253, filed on Aug. 16, 2005, now Pat. No. 7,134,928.

(51) Int. Cl.

| | |
|---|---|
| ***A63C 9/00*** | (2006.01) |
| ***A63C 9/08*** | (2006.01) |
| ***A63C 9/24*** | (2006.01) |
| ***B63B 35/85*** | (2006.01) |

(52) U.S. Cl. ..... 441/70; 280/617

(58) Field of Classification Search ..... 441/70; 280/617–625, 14.22, 14.23
See application file for complete search history.

(56) References Cited

U.S. PATENT DOCUMENTS

| | | | | |
|---|---|---|---|---|
| 4,265,034 | A * | 5/1981 | Salomon | 36/118.8 |
| 5,354,088 | A * | 10/1994 | Vetter et al. | 280/618 |
| 5,356,170 | A * | 10/1994 | Carpenter et al. | 280/618 |
| 5,417,443 | A * | 5/1995 | Blattner et al. | 280/14.21 |

(Continued)

*Primary Examiner*—Ajay Vasudeva
(74) *Attorney, Agent, or Firm*—Christensen O'Connor Johnson Kindness PLLC

(57) ABSTRACT

A water sport binding is disclosed having a rigid base plate that is adapted to be mounted to a board such as a wake board. A heel loop is pivotably mounted to the base plate and a flexible upper assembly is provided that includes a forward portion that attaches to the base plate and a rearward portion that attaches to the pivotable heel loop. A lever mechanism, including a lever mounted on the heel loop and a cable that attaches to either side of the base plate and extends through a channel in the lever provides a mechanism for locking the heel loop in an upright position during use. The user pivots the lever to permit the heel loop to pivot rearwardly, permitting ready entry or egress from the binding. The flexible upper assembly may include front and back panels, an instep support, an ankle support, and attachment means.

12 Claims, 4 Drawing Sheets

U.S. PATENT DOCUMENTS

| | | | | |
|---|---|---|---|---|
| 5,624,291 | A | 4/1997 | McClaskey | |
| 5,660,410 | A * | 8/1997 | Alden | 280/627 |
| 5,947,781 | A | 9/1999 | Von Wald | |
| 6,174,212 | B1 * | 1/2001 | Chang | 441/70 |
| 6,336,650 | B1 * | 1/2002 | Alspaugh | 280/613 |
| 6,390,492 | B1 | 5/2002 | Bumgarner | |
| 6,557,865 | B1 * | 5/2003 | Reuss et al. | 280/14.21 |
| 6,641,163 | B2 * | 11/2003 | Joubert des Ouches | 280/624 |
| 6,659,493 | B1 * | 12/2003 | Trnka | 280/607 |
| 6,726,238 | B2 * | 4/2004 | Poscich | 280/624 |
| 6,855,023 | B2 | 2/2005 | Berger | |
| 6,955,362 | B2 * | 10/2005 | Bazzi | 280/14.22 |
| 7,147,233 | B2 * | 12/2006 | Edmond | 280/14.22 |
| 7,246,811 | B2 * | 7/2007 | Martin | 280/611 |
| 2004/0119265 | A1 | 6/2004 | Draper | |

* cited by examiner

BINDING FOR WATER SPORTS BOARDS

CROSS-REFERENCE TO RELATED APPLICATION

This application is the National Stage of International Application No. PCT/US06/32075, filed Aug. 15, 2006, which is a continuation of U.S. application Ser. No. 11/206,253, filed Aug. 16, 2005, now U.S. Pat. No. 7,134,928, issued Nov. 14, 2006 the disclosure of which is hereby incorporated by reference in its entirety as if set forth fully herein.

FIELD OF THE INVENTION

This invention relates to foot bindings for wake boards, water skis, and other water sports boards and, more specifically, to bindings that are relatively easy to engage.

BACKGROUND OF THE INVENTION

Water skis, wake boards, and other water sporting boards generally require a binding that releasably attaches the user to the water sports board. Typically, a user rides a wake board while being towed behind a boat or jet ski. The wake board resembles a surf board but, unlike a surf board, the wake board includes bindings that attach the feet of a rider onto the top surface of the wake board.

One challenge associated with bindings for wake boards and water skis is that the binding must securely hold the rider's foot in contact with the wake board during rigorous use and during relatively benign falls, but must be flexible enough to allow release of the rider upon a sufficiently violent fall. Prior art bindings addressed these problems in a number of ways. For example, some water sports bindings are designed primarily of an elastic material that is stretchable to fit and grip many different foot sizes, but is sufficiently stretchable to release the foot upon a sufficiently dynamic fall. These designs are often uncomfortable, however, because the stretchable material is tensioned around the entire foot to hold the rider in place. An example of a prior art wake board binding having this construction can be found in U.S. Pat. No. 5,624,291 to McClaskey. The wake board binding in McClaskey includes two strips that are attached at the top of the wake board on opposite sides of a heel of a rider. The strips extend upward around the instep of the rider and are attached by hook-and-loop material. Attachment of the two strips binds the rider's foot to the upper surface of the wake board and maintains the rider's foot against the upper surface.

Another type of water ski or wake board binding is formed primarily of a semirigid material. For example, the two patents to Uren et al. (U.S. Pat. No. 5,181,332 and U.S. Pat. No. 5,334,065) disclose a water ski boot and binding including rigid side panels or cowls, rigid heel supports, and straps mounted over the instep of a rider's foot. A rigid cuff extends around the ankle of the rider that is made as a monolithic tube of stiff, semirigid, or substantially rigid plastic material. A problem with this design is that it does not permit release of the rider's foot, but instead, the boot releases from the ski upon a fall.

In yet another type of water sports binding, a releasable boot is worn by the user, wherein the boot is attachable to the binding. An example of this type of binding is found in U.S. Pat. No. 6,855,023 to Berger et al., wherein a coupling is attached to the sole of the boot, the coupling being adapted to mate with a second coupling attached to a lower attachment plate. These bindings require the user to wear relatively heavy and uncomfortable boots in the water and have not gained wide acceptance.

All of the prior art water sports bindings are difficult or impossible to engage while in the water, so if a user falls and releases from the binding, the user may have to return to shore or onto the pulling watercraft to re-engage the binding to continue the sport. There remains a need for water sports bindings that provide the functional benefits of a binding and that also are relatively easy to engage while in the water.

SUMMARY OF THE INVENTION

A binding assembly that is suited for use in water sports such as water skiing and wake boarding is disclosed. The binding is for releasably attaching a user's foot to the water sports board and includes a rigid base plate that may be made, for example, of a material suitable for use in the water—such as aluminum, a rigid plastic, or a composite material. A pliable foot pad is provided atop the base plate and may be relatively thick and compressible for user comfort. A heel loop is pivotably attached to the base plate near a heel end of the base plate. The heel loop is generally U-shaped and adapted to extend generally around the heel of the user. The heel loop pivots between an upright position, wherein the user's foot is secured in the binding, and a release or rearward position to facilitate entry and exit from the binding. A flexible upper assembly is attached to the base plate and adapted to substantially surround and secure the user's foot to the board. The flexible upper assembly includes a front portion that attaches to the base plate, preferably with inner and outer attachment rails, and a rear portion that attaches to the base plate through the pivotable heel loop. A lever mechanism having a lever mounted to the heel loop and a cable extending to either side of the base plate releasably locks the heel loop in the upright position during use.

In an embodiment of the invention, the binding further includes a vibration-absorbing pad disposed between the base plate and the water sports board.

In an embodiment of the invention, the flexible upper includes a front panel and an instep support attached to the base plate and a back panel and ankle support attached to the heel loop.

In an embodiment of the invention, the heel loop is rigid and may be formed from the same material as the rigid base plate.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

A currently preferred embodiment of a water sports binding 100 according to the present invention will now be described with reference to the figures, wherein like numbers indicate like parts.

Figure 1:
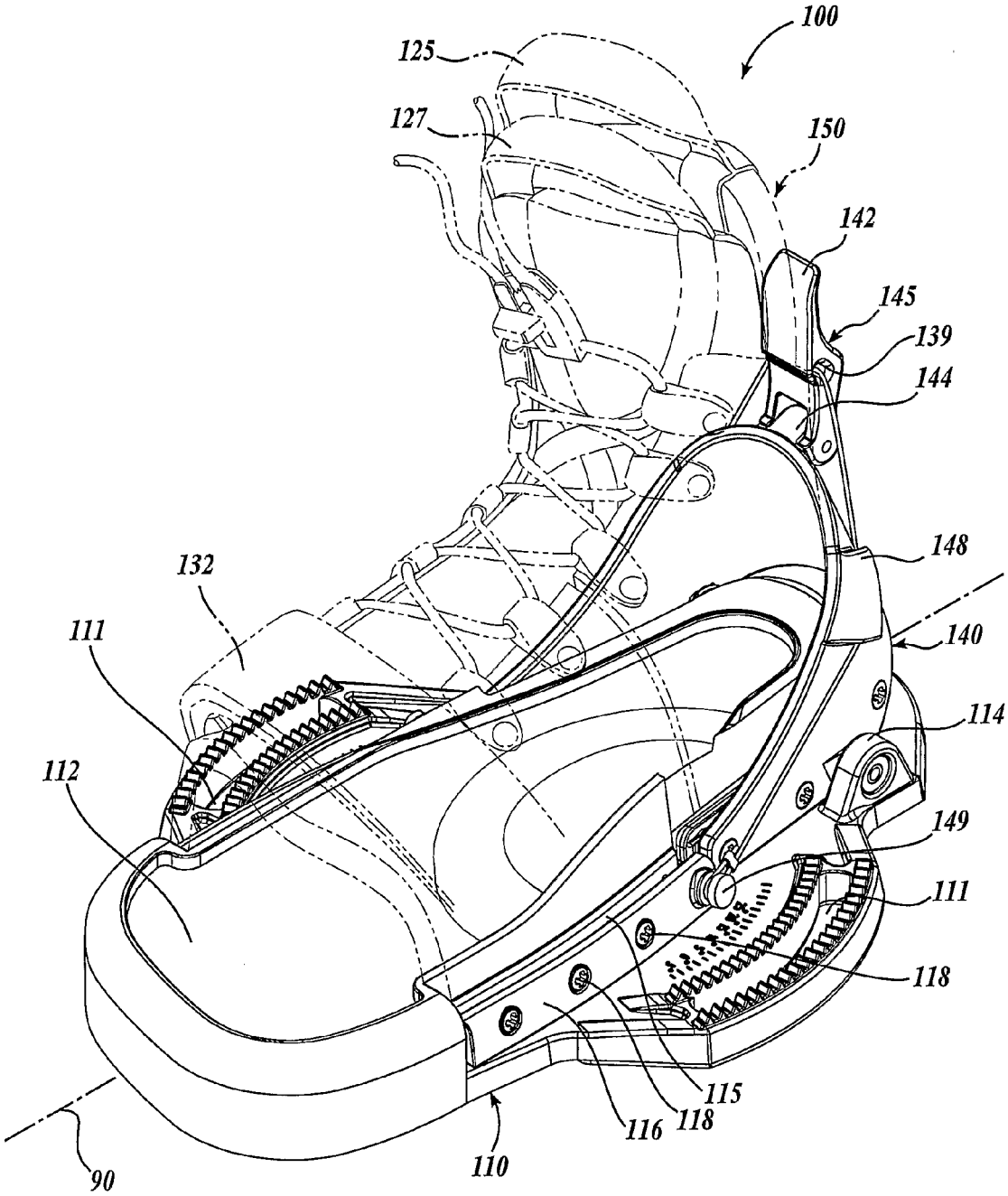
FIG. 1 is a perspective view of a water sports binding according to the present invention, with the generally pliable upper portions of the binding shown in phantom.
Figure 2:
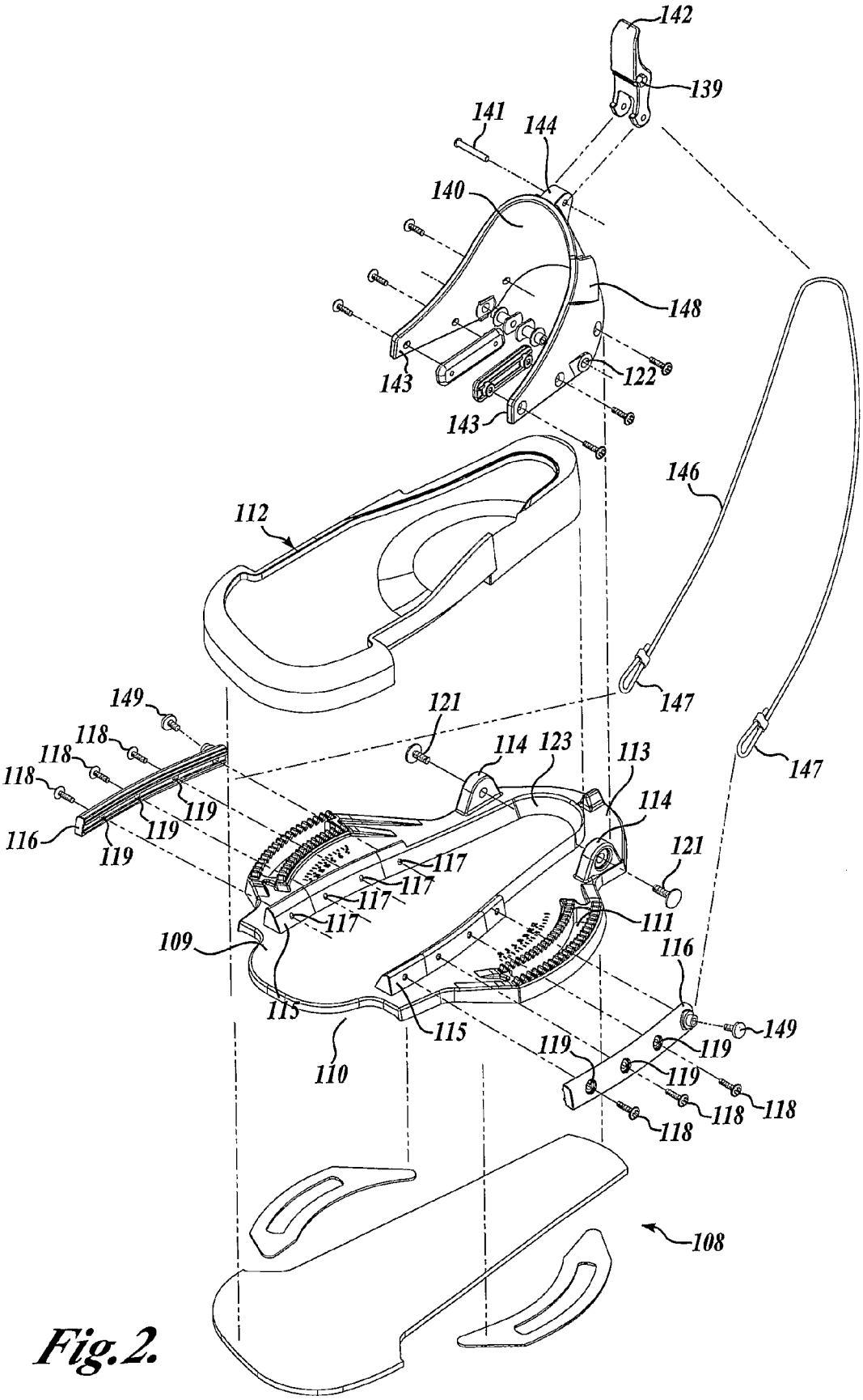
FIG. 2 is an exploded view of the water sports binding shown in FIG. 1, wherein the generally pliable upper portions are removed for clarity.

Referring first to FIGS. 1 and 2, FIG. 1 shows a perspective view of the water sports binding 100, wherein the flexible upper assembly 150 is shown in phantom to better expose certain novel aspects of the present invention. An exploded view of the binding 100 with the upper assembly 150 removed for clarity is shown in FIG. 2. Although the water sports binding 100 described in this embodiment is intended for use with a wake board (not shown), it is contemplated that the present invention may also be practiced with other water sports boards, including water skis and the like.

The binding 100 includes a substantially rigid base plate 110 that is adapted to be adjustably mounted on a wake board, the base plate 110 having a front or toe end 109 and a back or heel end 113. In a current embodiment, the base plate 110 is formed from a composite material, such as a glass-filled nylon composite, although other suitable materials are appropriate and within the skill in the art to identify. A vibration-absorbing pad 108, which may be a unitary pad or formed in multiple portions (three portions shown), underlies the base plate 110. The base plate 110 includes oppositely-disposed, curved, elongate apertures or slots 111 such that the angular position of the base plate 110 on the wake board may be selectively fixed using conventional attachment hardware (not shown). Other configurations for attaching the base plate 110 to a wake board are also contemplated and are well-known in the art including, for example, using a plurality of spaced apertures rather than elongate slots. A relatively thick foot pad 112 is provided on top of the base plate 110 and is preferably affixed to the base plate 110. The foot pad 112 is preferably formed from a closed-cell polymeric foam and may extend beyond the toe end 109 of the base plate 110.

The base plate 110 includes left and right inner attachment rails 115 that extend upwardly from the base plate 110. In the current embodiment the attachment rails 115 are connected by a rib portion 123 that extends generally around towards the heel end 113 of the base plate 110, stiffening the base plate 110. The inner attachment rails 115 include a plurality of threaded apertures 117. The inner attachment rails 115 may be separable components—for example, elongate members attached to the base plate 110 with conventional attachment hardware (not shown) extending through the bottom of the base plate 110. In the current embodiment, the inner attachment rails 115 are integrally formed with the base plate 110. Left and right outer attachment rails 116 are releasably attachable to the corresponding inner attachment rails 115—for example, using bolts 118 that extend through apertures 119 in the outer attachment rails 116 and engage the threaded apertures 117. It will be apparent to those of skill in the art that the inner and outer attachment rails 115, 116 are suitable for attaching portions of the upper assembly 150 to the base plate 110, as discussed below.

A rigid U-shaped heel loop 140 is pivotably attached to the base plate 110. In the preferred embodiment, the heel loop 140 is attached through a pair of oppositely-disposed lugs 114 extending upwardly from the base plate 110. The heel loop 140 may also be formed, for example, from a glass-filled nylon. Pivot pins 121 (including conventional attachment hardware) extend through each lug 114 and through a corresponding aperture 122 in a lower portion of the heel loop 140, such that the heel loop 140 is pivotable relative to the base plate 110 through an angle about an axis transverse to the longitudinal axis 90 of the binding 100. The heel loop 140 includes oppositely-disposed forward leg portions 143 that abut the base plate 110 to limit the forward pivoting of the heel loop 140.

A lever mechanism 145 allows the pivotable heel loop 140 to be locked in an upright position during use. The lever mechanism 145 includes a lever 142 that is pivotably mounted on the back of the heel loop 140 through an integral center lug 144 and using pivot pin mounting hardware 141. The lever 142 is movable between a first position (the upper position in FIG. 3), wherein the heel loop 140 is held in the upright position, and a second position, wherein the heel loop 140 is pivotable rearwardly. The lever 142 includes a channel 139 that slidably engages a cable 146 having loop portions 147 at each end that attach to posts 149 fixed on opposite sides of the base plate 110. A pair of cable guides 148 (one visible in the figures) is mounted to the heel loop 140 intermediate of the leg portions 143 and the lever 142 to position and retain the cable 146. It will be appreciated that the length of the cable 146 is selected such that when the lever 142 is in the first (upper) position shown in FIG. 3, the tension in the cable 146 urges the lever toward the heel loop 140 such that the lever 146 tends to stay in the first position and the heel loop 140 is held in the upright position wherein the leg portions 143 abut the base plate 110.

Figure 3:
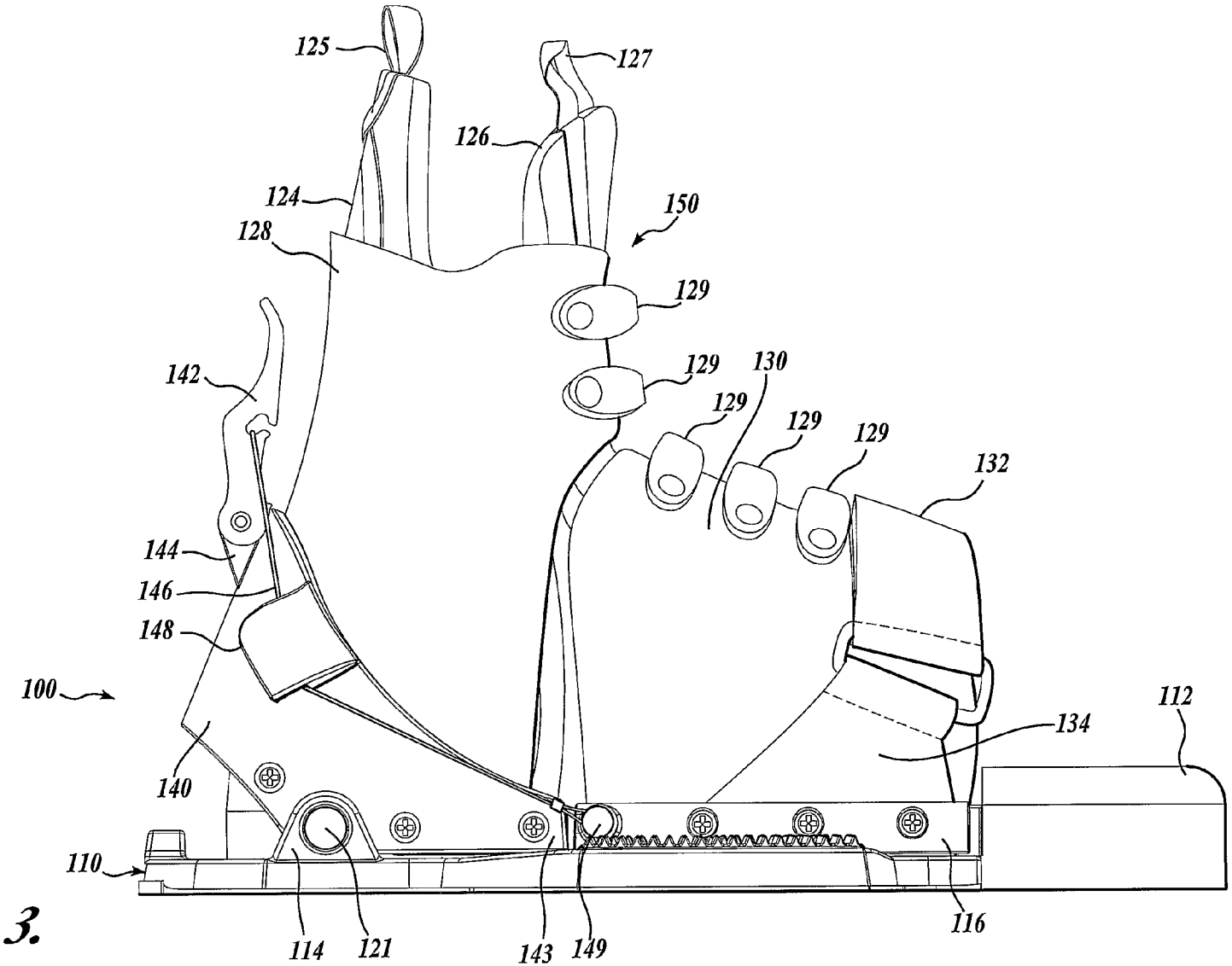
FIG. 3 is a side view of the water sports binding shown in FIG. 1.

Referring in particular now to FIG. 3 that shows a side view of the binding 100, the flexible upper assembly 150 of the preferred embodiment will now be described. The upper assembly 150 is made substantially from pliable elements that comfortably and securely engage a user's foot. The upper assembly 150 of the preferred embodiment includes a forward portion attached to the base plate 110 and a rearward portion attached to the heel loop 140. A back panel 124 extends upwardly behind the foot and ankle of the user and is attached to the base plate 110 through the pivotable heel loop 140. The back panel 124 is curved about an upright axis to generally conform to the back of the user's foot and leg and optionally includes a pull loop 125 fixedly attached at an upper end of the back panel 124. A front panel 126 extends upwardly from the base plate 110 and is attached to the base plate 110 by clamping between the inner and outer attachment rails 115, 116 described above (FIG. 2). The front panel 126 overlies the user's instep and front ankle and optionally includes a second pull loop 127 fixedly attached to the top end of the front panel 126. The back panel 124 and front panel 126 may be formed from a closed-cell, polymeric foam material to substantially wrap the user's ankle in a comfortable and flexible assembly and may include a relatively soft and compressible inner portion that is permanently adhered to a denser and less compressible outer portion.

A relatively sturdy ankle support 128 is attached to the heel loop 140 between the back panel 124 and the heel loop 140. The ankle support 128 is preferably formed from a rubbery polymeric material and wraps generally around the user's ankle. A plurality of keepers 129 is attached to the ankle support 128, whereby the ankle support 128 can be fixed about the user's ankle with a lace (not shown). Alternatively, a strap with an alternative attachment mechanism, such as a hook-and-loop type material or a mechanical clasp, may be used to adjustably attach the ankle support 128 about the user's ankle.

Similarly, relatively sturdy left and right instep supports 130 (right instep support visible in FIG. 3) are attached to the base plate 110 between the inner attachment rail 115 and outer attachment rail 116. The left and right instep supports 130 may be formed from the same material as the ankle support 128 and extend generally over the user's instep. A plurality of keepers 129 is provided such that the instep support 130 can be adjustably fixed about the user's instep with the lace (not shown) to comfortably secure the user to the binding 100. It will be readily apparent that alternative attachment means may be utilized as discussed above. In the disclosed embodiment an optional forward toe strap 132 is also provided. The optional toe strap 132 is substantially inelastic and is adjustably attached to strap supports 134 disposed on either side of the base plate 110 (one visible in FIG. 3). The strap supports 134 are attached to the base plate 110 through the inner attachment rail 115 and outer attachment rail 116. The toe strap 132 of the preferred embodiment is adjustably secured about the user's foot using hook-and-loop type panels (not shown). In another preferred embodiment the binding does not include a toe strap.

Figure 4:
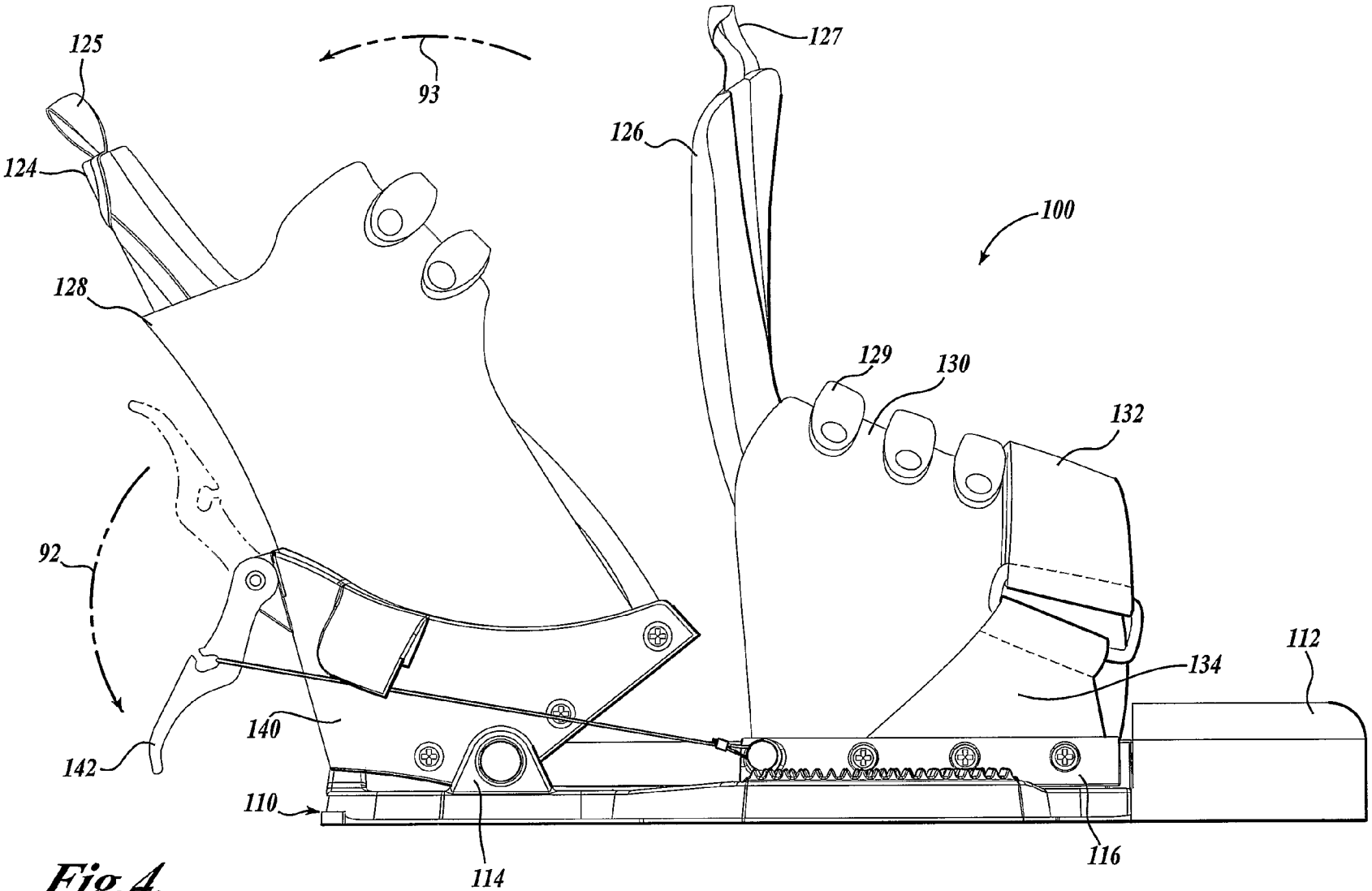
FIG. 4 is a side view of the water sports binding shown in FIG. 1 and showing the heel loop pivoted to the release position.

A novel aspect of the binding 100 is the heel loop 140 that is pivotably attached to the base plate 110. As shown in FIG. 4, to facilitate entry or egress from the binding 100, the user moves the lever 142 from the first (upper) position (shown in phantom in FIG. 4) to the release or second position, as indicate by arrow 92. This loosens the tension in the cable 146, thereby permitting the user to pivot the heel loop 140 rearwardly, as indicated by arrow 93. The back panel 124 and ankle support 128 are attached to the heel loop 140 and, therefore, pivot with the heel loop 140 away from the front panel 126 and instep support 130. This action opens the binding 100, allowing the user to easily engage or disengage from the binding 100. When engaging the binding 100, the user inserts a foot between the foot pad 112 and the front panel 126 (which may be greatly facilitated by using pull loops 125, 127) and pivots the lever 142 from the second or lower position back to the first or upper position.

It will be apparent to persons of skill in the art that the present invention provides substantial benefits for water sports applications, wherein a user may frequently wish to engage the binding 100 while floating in the water. In prior art bindings, the elasticity of the upper assembly is typically relied upon to provide sufficient stretching to allow the user to insert a foot, while also providing sufficient binding forces to securely retain the user's foot. The present invention eases the process of engaging the binding so that a user can quite easily reenter the binding while in the water. It will also be appreciated that, in embodiments wherein the heel loop 140 is rigid, the heel loop 140 also provides the user with improved leverage on the water sports board, which can improve the user's comfort and ease in manipulating the board during use.

While the preferred embodiment of the invention has been illustrated and described, it will be appreciated that various changes can be made therein without departing from the spirit and scope of the invention.

The invention claimed is:

1. A binding configured for releasably attaching a user's foot to a water sports board, the binding comprising:

a base plate configured for attachment to the water sports board, the base plate having a toe end and a heel end;

a vibration absorbing pad that underlies the base plate;

a foot pad formed from a flexible and compressible closed cell polymeric foam attached to an upper surface of the base plate;

a heel loop pivotably attached to the base plate near the heel end of the base plate; and an upper assembly having a flexible and compressible front portion comprising a closed cell polymeric foam attached to the base plate and a flexible and compressible rear portion comprising a closed cell polymeric foam attached to the heel loop;

wherein the base plate further comprises a pair of attachment rails, and the front portion of the upper assembly attaches to the pair of attachment rails; and wherein the rear portion of the upper assembly is movable between a lockable upright position and a rearward release position.

2. The binding of claim 1 wherein the rear portion of the upper assembly includes a pliable back panel and a relatively sturdy ankle support.

3. The binding of claim 1 wherein the front portion of the upper assembly includes a pliable front panel and a relatively sturdy instep support.

4. The binding of claim 1 wherein the base plate includes at least one elongate slot adapted to mount the base plate at a selectable rotational orientation.

5. The binding of claim 1, further comprising a cable and lever assembly that releasably locks the rear portion of the upper assembly in the lockable upright position.

6. The binding of claim 1 wherein the heel loop is rigid.

7. The binding of claim 6 wherein the base plate further comprises a pair of lugs, and the heel loop is pivotably attached to the base plate through the pair of lugs.

8. The binding of claim 1, further comprising a pair of outer attachment rails that are removably attachable to the base plate attachment rails.

9. A binding configured for releasably attaching a user's foot to a water sports board, the binding comprising:

a base plate configured for attachment to the water sports board;

a foot pad formed from a flexible and compressible closed cell polymeric foam affixed to an upper surface of the base plate;

a vibration absorbing pad that underlies the base plate;

a U-shaped heel loop pivotably attached to the base plate and movable between an upright locked position and a release position;

a cable and lever assembly that releasably locks the heel loop in the upright locked position; and an upper assembly comprising a flexible and compressible instep portion comprising a closed cell polymeric foam attached to the base plate and adapted to engage an instep portion of the user's foot, and a flexible and compressible ankle portion comprising a closed cell polymeric foam attached to the heel loop and adapted to engage an ankle portion of the user's foot.

10. The binding of claim 9 wherein the ankle portion of the upper assembly includes a pliable back panel and a relatively sturdy ankle support.

11. The binding of claim 9 wherein the instep portion of the upper assembly includes a pliable front panel and a relatively sturdy instep support.

12. A water sports binding configured for releasably attaching a user's foot to a water sports board, the water sports binding comprising:

a base plate configured for attachment to the water sports board;

a flexible and compressible foot pad attached to the base plate such that the foot pad underlies a user's foot during use;

a vibration absorbing pad that underlies the base plate;

an upper assembly having a flexible and compressible front panel comprising a closed cell polymeric foam attached to the base plate and extending upwardly from the base plate, and a flexible and compressible back panel comprising a closed cell polymeric foam that is pivotably attached to the base plate; and means for pivoting the back panel between a locked upright position for retaining a user's foot, and a second release position to permit ingress and egress from the binding;

wherein the means for pivoting the back panel comprises a U-shaped heel loop that is pivotably attached to the base plate and a cable and lever assembly means that is releasably positionable to lock the back panel in the upright position.

* * * * *